US009549576B2

(12) United States Patent
Conolly et al.

(10) Patent No.: US 9,549,576 B2
(45) Date of Patent: Jan. 24, 2017

(54) WATERSPORT HIKING SUPPORT SYSTEM

(71) Applicant: Zhik Pty Ltd, Artarmon, New South Wales (AU)

(72) Inventors: Brian John Conolly, Northwood (AU); Thomas Kenneth Hussey, Balmain (AU); Bartosz Milczarczyk, Lane Cove (AU); Andrue Kerr, Revesby Heights (AU)

(73) Assignee: Zhik Pty Ltd, Artarmon, New South (AU)

( * ) Notice: Subject to any disclaimer, the term of this patent is extended or adjusted under 35 U.S.C. 154(b) by 0 days.

(21) Appl. No.: 14/548,571

(22) Filed: Nov. 20, 2014

(65) Prior Publication Data

US 2015/0143621 A1 May 28, 2015

(30) Foreign Application Priority Data

Nov. 25, 2013 (AU) ..... 2013904543

(51) Int. Cl.

| | |
|---|---|
| ***A41D 13/00*** | (2006.01) |
| ***A41D 13/012*** | (2006.01) |
| ***B63H 9/10*** | (2006.01) |
| ***A63B 21/00*** | (2006.01) |
| ***A63B 21/068*** | (2006.01) |
| ***A63B 23/02*** | (2006.01) |
| *A41D 13/05* | (2006.01) |
| *A63B 71/12* | (2006.01) |
| *A63B 21/055* | (2006.01) |

(52) U.S. Cl.

CPC ..... *A41D 13/0007* (2013.01); *A41D 13/012* (2013.01); *A63B 21/00181* (2013.01); *A63B 21/068* (2013.01); *A63B 21/4007* (2015.10); *A63B 21/4011* (2015.10); *A63B 21/4015* (2015.10); *A63B 21/4025* (2015.10); *A63B 23/0211* (2013.01); *B63H 9/1014* (2013.01); *A41D 13/0531* (2013.01); *A41D 13/0543* (2013.01); *A63B 21/0552* (2013.01); *A63B 23/0238* (2013.01); *A63B 71/12* (2013.01)

(58) Field of Classification Search

CPC .... A41B 13/06; A41D 13/0015; A41D 13/02; A41D 1/06

USPC ..... 2/69, 69.5, 79, 108, 227, 228, 238, 24,2/467

See application file for complete search history.

(56) References Cited

U.S. PATENT DOCUMENTS 2,280,274 A * 4/1942 Wildermuth ..... A61H 1/008 482/131
4,773,106 A * 9/1988 Toso ..... A47C 16/00 297/464

(Continued)

FOREIGN PATENT DOCUMENTS

EP 2589307 A1 5/2013
GB 2461072 A 12/2009

(Continued)

OTHER PUBLICATIONS

Search Report from Great Britain, Application No. GB1420577.7, Issued: Apr. 20, 2015, 2 pages.

*Primary Examiner* — Tejash Patel
(74) *Attorney, Agent, or Firm* — Whitmyer IP Group LLC

(57) ABSTRACT

A device that provides support for sailors while hiking from a sailing vessel is disclosed. The device includes a garment that is shaped and/or configured to resist the backwards leaning moment of a sailor whilst hiking thereby reducing muscular strain and effort.

24 Claims, 11 Drawing Sheets

(56) References Cited

U.S. PATENT DOCUMENTS

| | | | | | |
|---|---|---|---|---|---|
| 5,375,279 | A | * | 12/1994 | Toso | A47C 16/00 5/633 |
| 5,643,184 | A | * | 7/1997 | Toso | A47C 16/00 2/44 |
| 6,213,922 | B1 | | 4/2001 | Afanasenko et al. | |
| 2006/0130215 | A1 | | 6/2006 | Torry | |
| 2009/0031478 | A1 | | 2/2009 | Conolly et al. | |
| 2013/0219579 | A1 | | 8/2013 | Molyneux et al. | |

FOREIGN PATENT DOCUMENTS

| | | | |
|---|---|---|---|
| JP | 2012161600 | A | 8/2012 |
| WO | 2014169335 | A1 | 10/2014 |

* cited by examiner

WATERSPORT HIKING SUPPORT SYSTEM

FIELD OF THE INVENTION

The invention generally relates to the field of sportswear products. More specifically, the invention relates to a novel hiking support system, which can be combined with sports clothing such as a wetsuit, in some embodiments, to help reduce muscle fatigue in situations such as hiking from the gunnels of a sailing vessel.

BACKGROUND OF THE INVENTION

Hiking support systems for hiking from a sailing dinghy like that shown in FIG. 1 have been applied to wetsuits for dinghy sailing for some time. Hiking allows the sailor to increase speed by increasing the moment that opposes the moment created by the sail. Hiking usually occurs from a seated position and is accomplished by leaning one's body weight over the edge of the boat. Dinghies are often equipped with hiking straps, under which sailors locate their feet and lean out to balance the boat. Hiking for long periods of time can put severe strain on the sailors body due the high loads involved and can be common cause for injury.

Hiking relies heavily on the lower extremities and trunk muscle groups. These forces are transferred to the lower back and knee through the muscles of the hip flexors. The hip flexor muscles connect the upper and inner knee to the hips and muscles of the lower back through the upper legs. In the hiking movement the hip flexors effectively leverage the torso. The core abdominal and lower back muscles help to hold the spine in column especially when the hip flexors work hard, which occurs frequently when hiking. The repetitive movements of hiking, improper lumber positioning and weak abdominal muscles contribute to excessive loading and as a result injury.

Problems occur when the core muscles are weak or fatigued and the body is extended beyond 150 degrees between legs and trunk. In this such case the hip flexor muscles are required to work harder to support the excess load applied to the upper body. In this circumstance the spinal joints and intervertebral discs can be damaged. The most common sites of injury are the lumbar spine and knees, with the spine particularly susceptible to ligamentous, muscle and disk injuries.

The muscles of the Hip flexors include the:

Sartorius muscle

Rectus femoris

Iliacus muscle

Iliopsoas (Iliacus and Psoas major) muscles

These muscles are relatively small and are not well adapted to the forces applied by the act of hiking. Training procedures for these muscles can be difficult and hard to target effectively. As a result, larger muscle groups of the abdomen and lumbar often compensate, fatiguing quickly or causing the above mentioned injuries.

It is known in the art to provide a wetsuit or other garment for hiking. These garments typically include a pair of closed cell foam pads with the addition of fiberglass battens positioned in the wetsuit behind the thigh. Other alternatives known in the art also include separate sleeves that contain similar pads that can then be worn underneath a wetsuit as disclosed by Conolly in US 2009/0031478. While said hiking support systems provide comfort to the wearer by spreading the point load from the edge of the boat across the sailors thigh, no support is provided to the core, upper body or lower extremities.

Accordingly there is a need for a hiking support system that provides support to the entire body thereby reducing muscular strain and injury whilst also providing performance advantages to the sailor.

SUMMARY OF THE INVENTION

Embodiments of the present invention include a support device that provides support to a sailor whilst hiking from the gunnels of a sailing vessel. The device aids to support the muscles in the abdomen and lumbar, improving body positioning and enhancing the muscles of the hip flexors. The device may act as a training device for muscle development or body positioning, as a support device to assist in the prevention of injury or as performance enhancing device.

In some embodiments, the present invention includes a form fitting garment that provides support to a sailor whilst hiking from the gunnels of a sailing vessel. Said garment is preferably in the form of a textile or textile and neoprene composite whereby the garment is designed in such a way to allow varying amounts of stretch in different parts of the garment to provide support to the sailor when in the hiking position.

BRIEF DESCRIPTION OF THE DRAWINGS

Notwithstanding any other forms which may fall within the scope of the present invention, preferred forms of the invention will now be described, by way of example only, with reference to the accompanying drawings in which.

DETAILED DESCRIPTION OF THE INVENTION

The present invention discloses a support device, such as a form fitting garment, that provides support to a sailor whilst hiking from the gunnels of a sailing vessel. Said support device is preferably in the form of a garment with an integrated support structure or an independent support device designed to be worn in conjunction with an under-garment and/or over-garment and/or independently by itself. Said support device is designed in such a way to support and/or enhance the muscles in the abdomen, lumbar and hip flexors. Some embodiments of such a support device are comprised substantially of a textile or textile and neoprene composite whereby the garment is designed in such a way to allow varying amounts of stretch in different parts of the garment to provide support.

Figure 1:
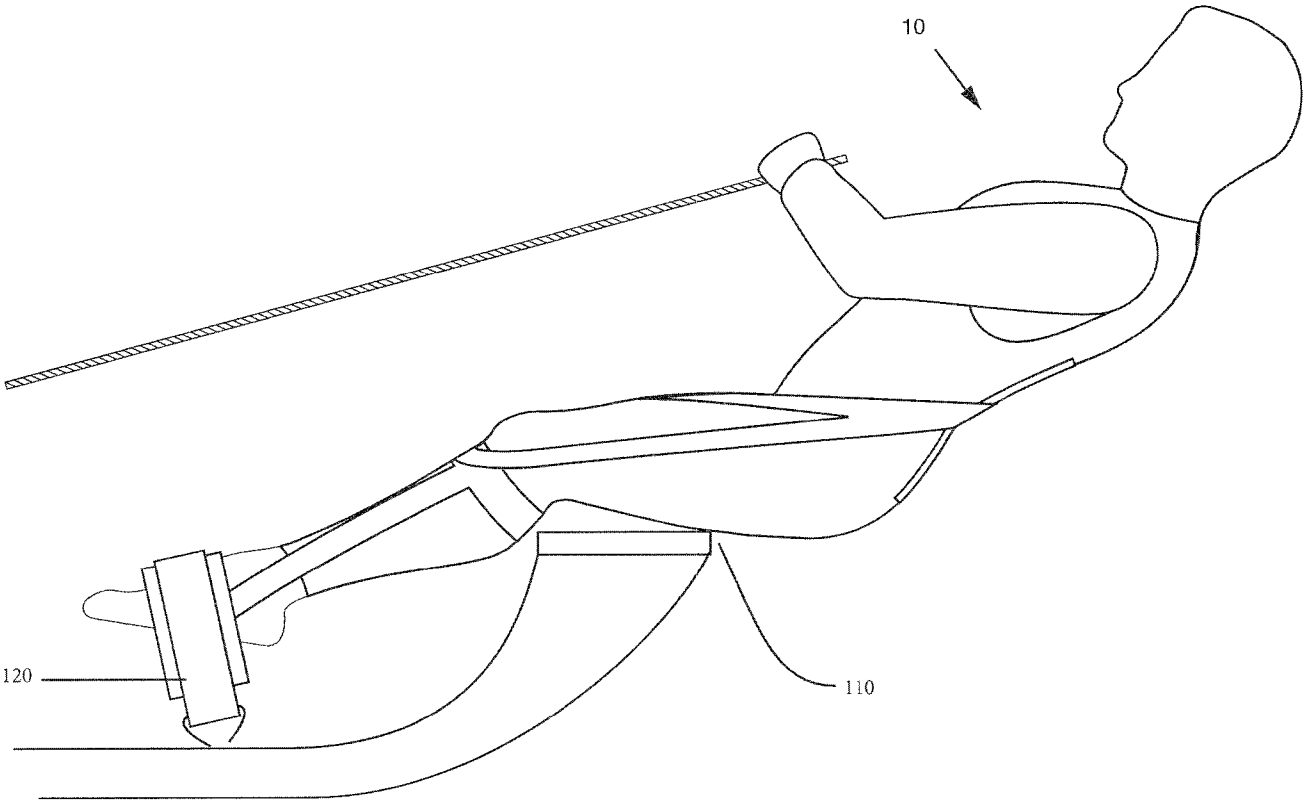
FIG. 1 illustrates a side view of a sailor in the hiking position wearing one embodiment of the present invention.

A side view of the hiking position of a sailor is illustrated in FIG. 1 whereby sailor 10 wearing a support garment suspends his upper body beyond boat 110 in a near horizontal position. Sailor 10 is in contact with boat 110 at the deck and foot strap 120. The present invention provides support by resisting the backward leaning moment of the sailor thereby reducing the muscular effort required to maintain the desired hiking position.

Figure 2:
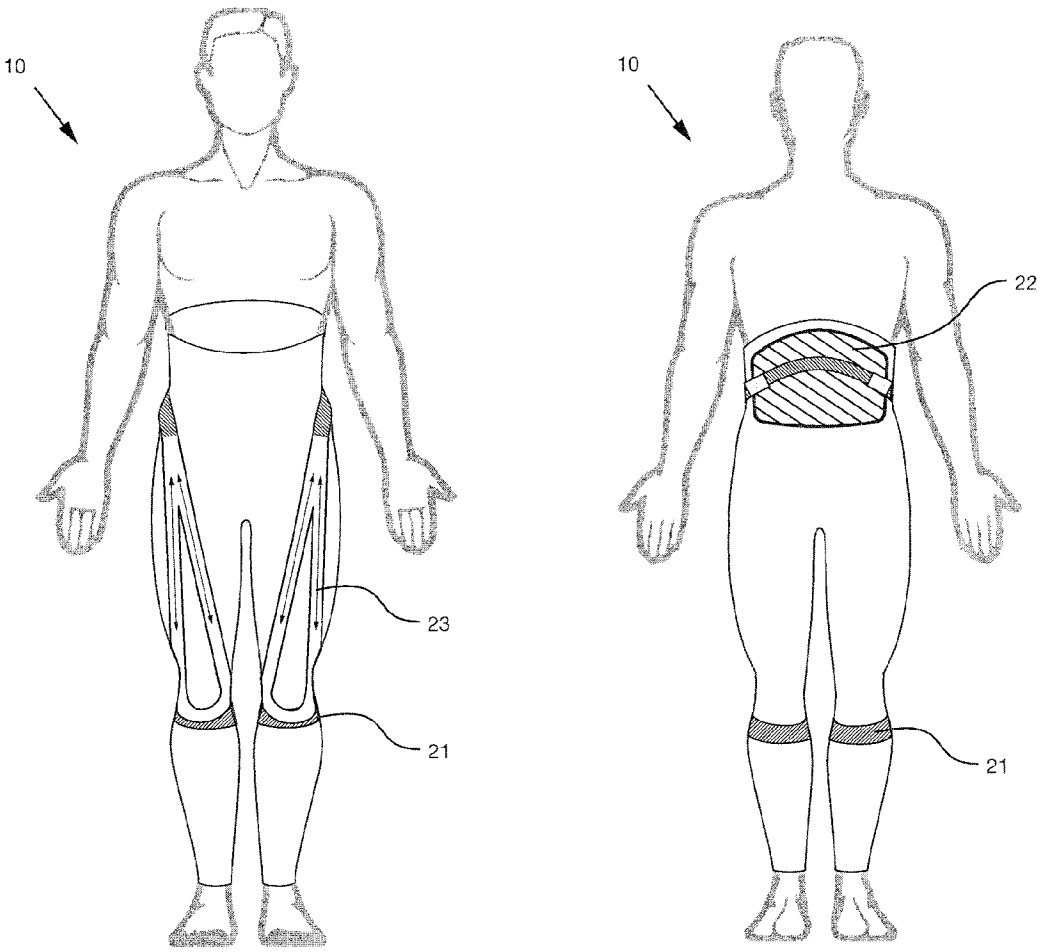
FIG. 2 illustrates the front side and rear view of one embodiment of the present invention when worn by a sailor.
Figure 3A:
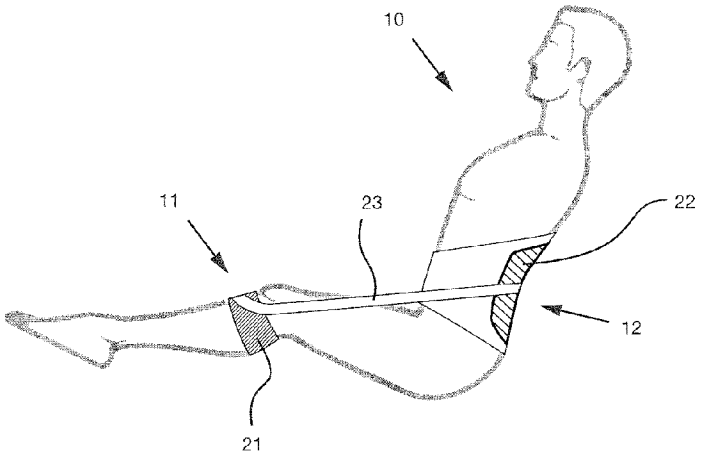
FIGS. 3A & 3B illustrate a side view of one embodiment of the present invention.
Figure 3B:
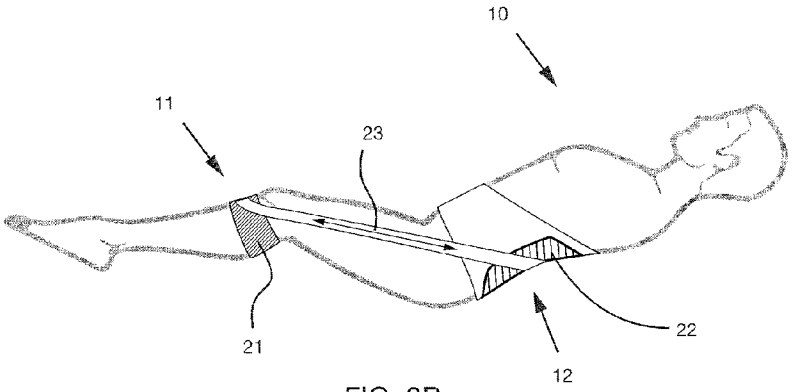

In a preferred embodiment of the present invention as shown in FIG. 2, FIG. 3A and FIG. 3B, said support device comprises a support material 23 attached at one end to the body of the sailor 10 at a region near the lower thighs or knees 11 and at another end to the lumbar region 12 of the sailor whereby said support material 23 is placed under load when the sailor 10 leans outwards whilst hiking from the gunnels of a sailing vessel.

In one aspect of the present invention, said support material 23 is secured to the lumbar region 12 of the sailor via a lumbar support structure 22 that is configured to spread the transferred load of the support material across the lumbar region. In another aspect of the present invention said support material 23 is secured to a region near the lower thighs or knees 11 of the sailor via lower leg support structures 21 that are configured to support the load from said support material 23. Attachment points to lumbar and low leg support structures 22 & 23 are configured such that when the sailor leans backwards, the support material is elongated thereby placing it in tension.

In one preferred embodiment, said support material is looped around the knees and is anchored to lower leg support structures 21 on the front top of the lower leg to provide optimum anchorage for the support material. In another preferred embodiment of the present invention, support material 23 preferably extends over the inner side and outer side of each thigh and attaches to the lumbar support structure. In one preferred embodiment, support material is comprised of multiple lengths of material or a single length of material that loops around the lower leg support structure of one leg then passes around the lumbar region and then loops around the lower leg support structure of the adjacent leg.

Support material may be constructed of materials including knitted, non-woven or woven textiles or textile composites such as neoprene and textile composites or polyurethane coated textiles, knitted or woven webbing or other straps or tapes or sheets including polymeric materials or composite thereof. In one preferred embodiment said support material is comprised of a high elastic modulus elastomeric webbing that exhibits between 10-20% elongation prior to tensile failure.

Figure 4C:
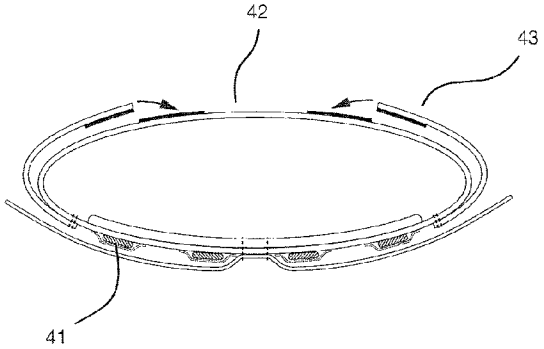
FIG. 4C illustrates top cross sectional detail of the lumbar support of one embodiment of the present invention.
Figure 4B:
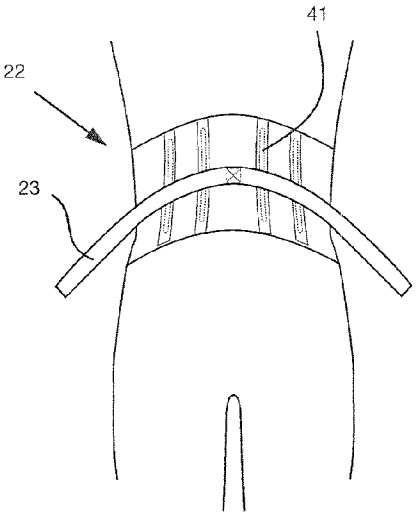
FIG. 4B illustrates a rear view detail of the lumbar support of one embodiment of the present invention.
Figure 4A:
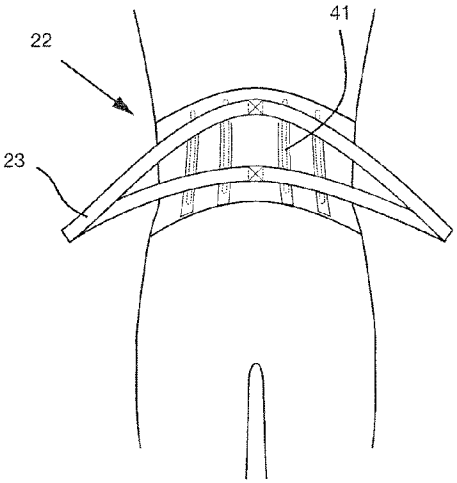
FIG. 4A illustrates a rear view detail of the lumbar support of one embodiment of the present invention.
Figure 4D:
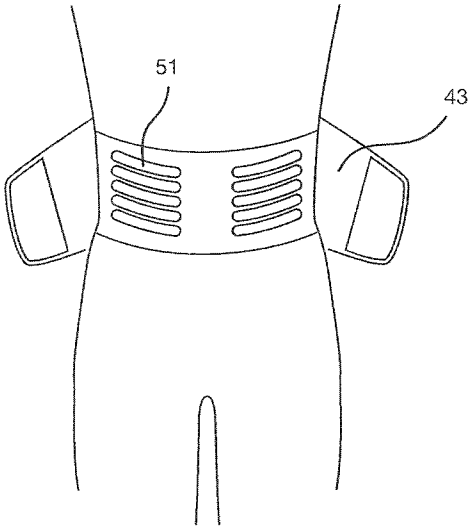
FIG. 4D illustrates a front view detail of the lumbar support of one embodiment of the present invention.

In one preferred embodiment of the invention, the support material is made from a material having less than 5% elongation between the lumbar support structure and the lower leg support structure prior to tensile failure. In another preferred embodiment of the invention, the support material is made from a material having between 5% and 30% elongation between the lumbar support structure and the lower leg support structure prior to tensile failure Said lumbar support structure is preferably comprised of a knitted, woven or non-woven textile, webbing or tape, closed or open cell foam or foam and textile composite or other composite. In a preferred embodiment shown in FIG. 4A, FIG. 4B and FIG. 4C, said lumbar support structure 22 contains a rigid support or series of supports 41 comprised of a lightweight yet strong material such as a moulded or extruded polymer, fibreglass composite, carbon fibre composite, aluminium, titanium, steel or other material. Said lumbar support structure 22 is fixed to said support material 23 at one or more attachment points. In a preferred embodiment said support structure preferably also features a method of tightening around the sailors torso via means of hook and loop fastening tabs 43 or other method. In a preferred embodiment said fastening method is preferably configured to provide optimal flexibility and movement around the torso by segmenting said hook and loop Velcro 51 as shown in FIG. 4D.

Figure 5A:
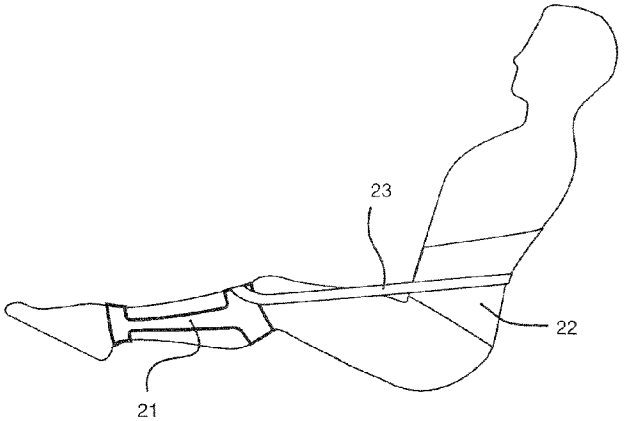
FIG. 5A illustrates a side view of one embodiment of the present invention.
Figure 5B:
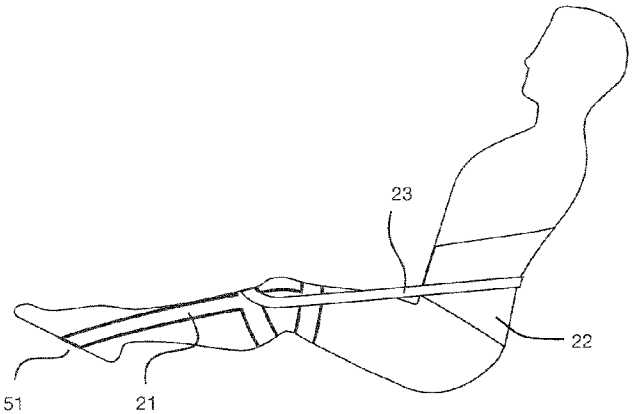
FIG. 5B illustrates a side view of one embodiment of the present invention.

In a preferred embodiment as shown in FIG. 5A said lower leg support structures 21 are provided by a structure that fastens to the sailors leg below the knee and also optionally around the ankle. Said structure is preferably comprised of a knitted, woven or non-woven textile, webbing or tape, closed or open cell foam or foam and textile composite or other composite or polymeric material and may optionally feature a method for tightening around the body by means such as hook and loop Velcro tabs or straps or other method to secure the support structure in place. In another preferred embodiment shown in FIG. 5B said lower leg support structures 21 also feature foot straps 51 that loop around the bottom of the foot to anchor the support.

Figure 5C:
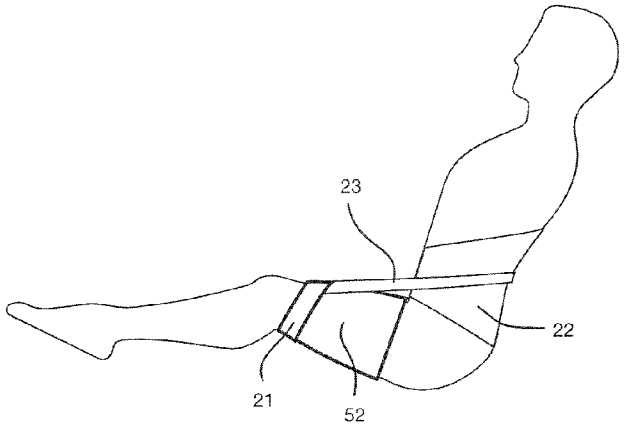
FIG. 5C illustrates a side view of one embodiment of the present invention.
Figure 5D:
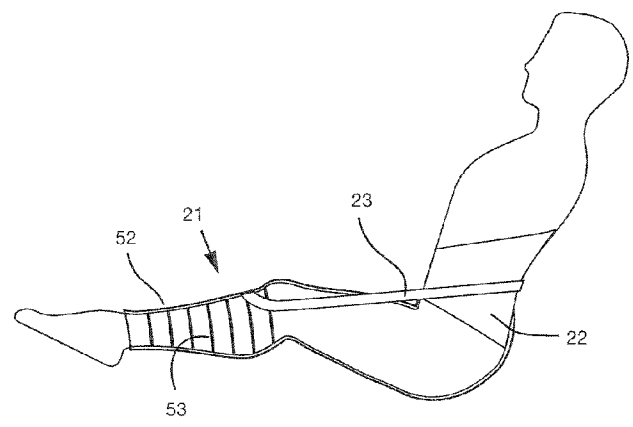
FIG. 5D illustrates a side view of one embodiment of the present invention.

In another preferred embodiment as shown in FIG. 5C said lower leg support structures 21 are fastened around the lower thighs and are preferably fastened to, or positioned adjacent to a hiking support sleeve 52 as disclosed by Conolly in US 2009/0031478.

In another preferred embodiment said lower leg support structures 21 are integrated into a garment which preferably comprises a series of high modulus elastomeric bands 53 that grip around the lower legs to secure the structures in place.

Figure 6:
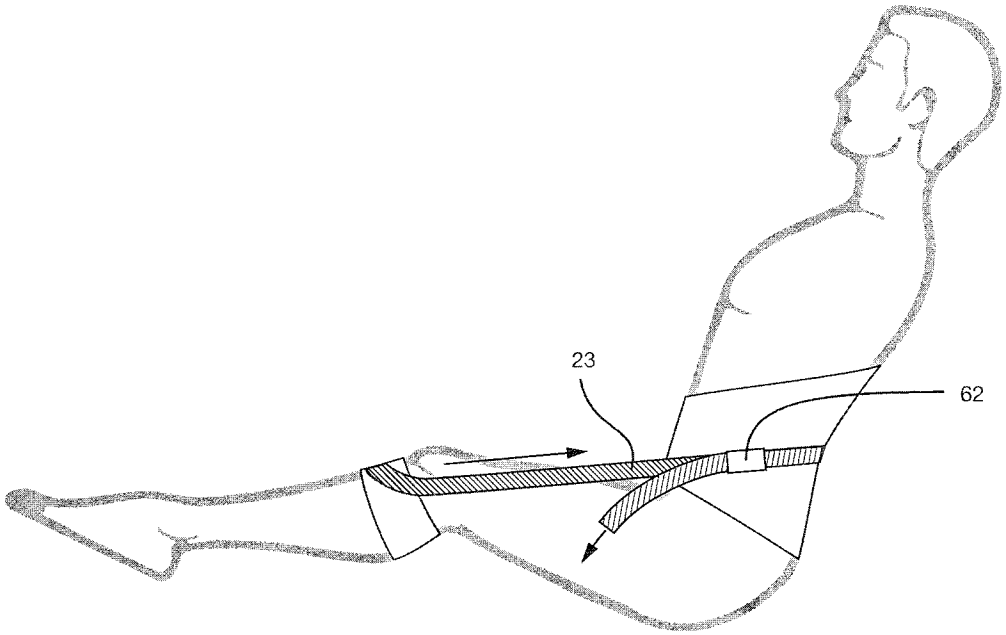
FIG. 6 illustrates a side view of one embodiment of the present invention.

In a preferred embodiment of the present invention, a method is provided to allow the adjustment of the tension of said support material 23. In one preferred embodiment shown in FIG. 6, said adjustment is provided by at least one strap with adjustment method 62. Said adjustment methods may be in the form of a buckle adjuster and/or hook and loop Velcro adjustment or other adjustment method to adjust the length of said strap. Said strap may be comprised of a knitted or woven webbing or binding or other flexible polymeric material and may be part of the support material or attached to the support material along its length or between the support material and the lumbar support structure and/or lower leg support structures.

Figure 7A:
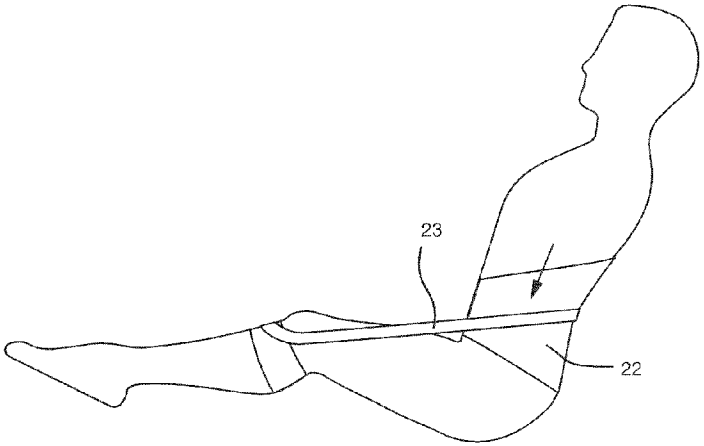
FIGS. 7A & 7B illustrate a side view of one embodiment of the present invention.
Figure 7B:
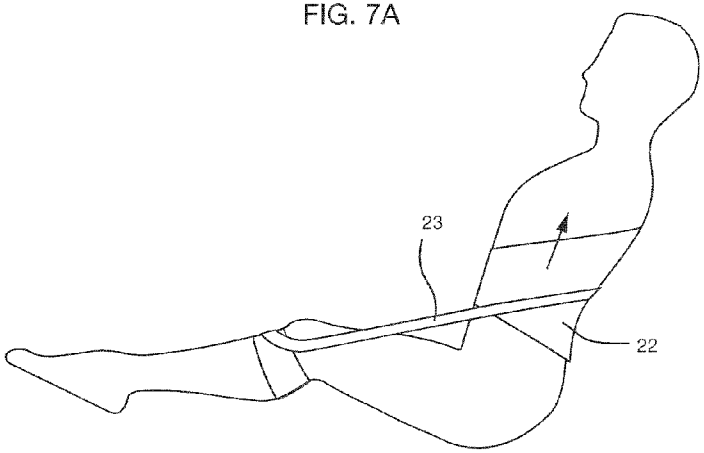
Figure 8:
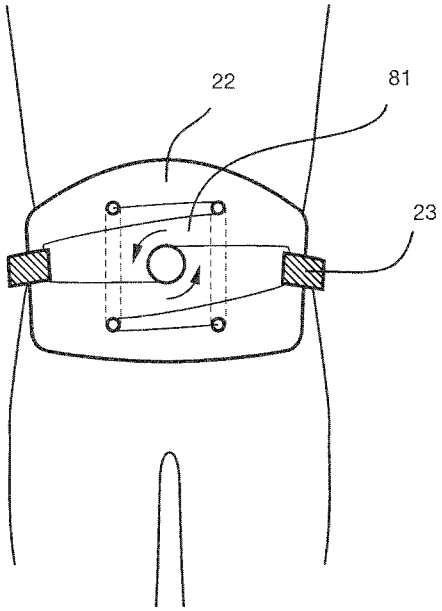
FIG. 8 illustrates a rear view detail of the lumbar support of one embodiment of the present invention.

In another preferred embodiment shown in FIG. 7A and FIG. 7B, the tension of the support material 23 is adjusted by moving the vertical position of the lumbar support structure 22 on the torso or by moving the vertical position of attachment point of the support material 23 to the lumbar support structure 22 on the torso thereby increasing the distance between the lumbar support structure 22 and lower leg support structures 21 increasing tension of support material 23. In another preferred embodiment shown in FIG. 8, the tension of the support material 23 is adjusted by means of a rotary cable adjustment system 24 as known in the art such as a BOA rotary adjustment produced by BOA Technology Inc. which is preferably positioned on the lumbar support structure 22 of the support device.

Figure 9C:
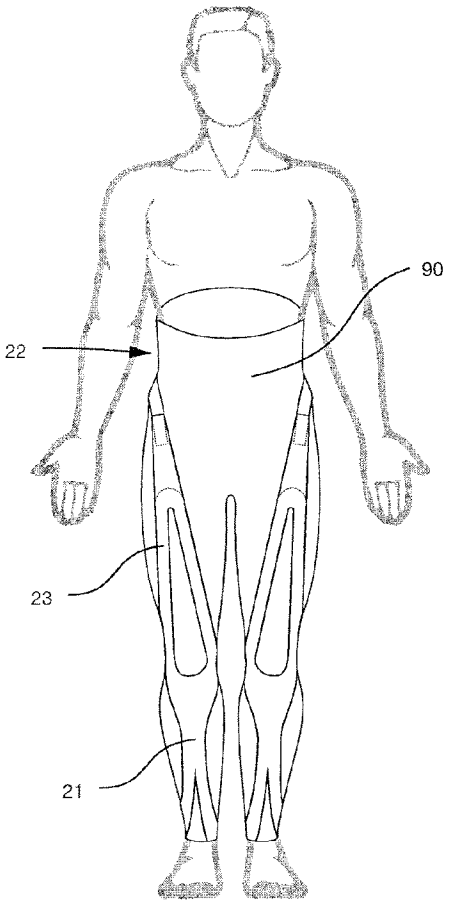
FIG. 9C illustrates a front view of one embodiment of the present invention.
Figure 9B:
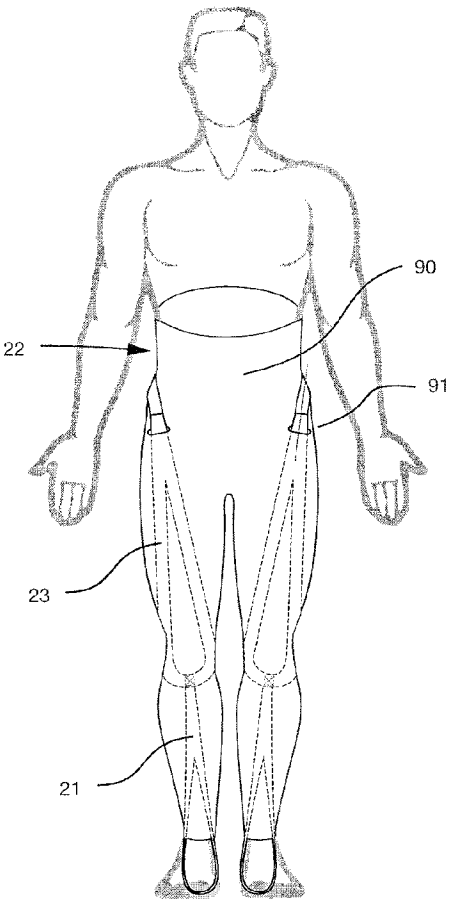
FIG. 9B illustrates a front view of one embodiment of the present invention.
Figure 9A:
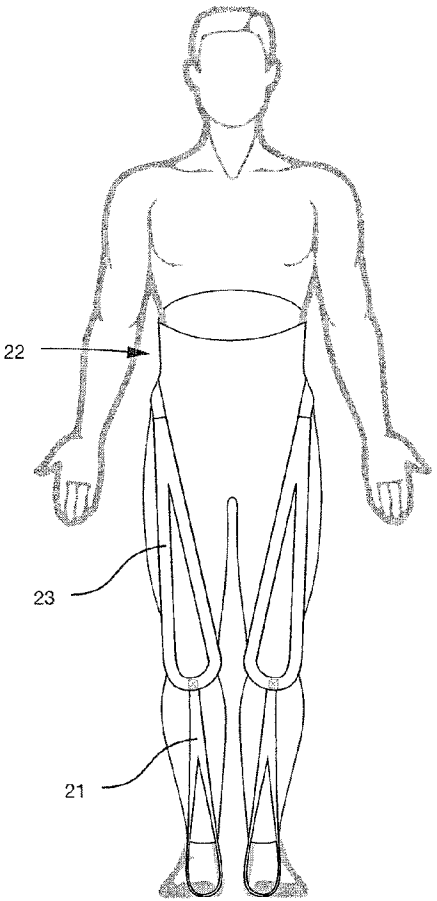
FIG. 9A illustrates a front view of one embodiment of the present invention.

In one embodiment of the present invention as shown in FIG. 9A said support device is designed as a separate support that can be worn in conjunction with an undergarment and/or over-garment and/or independently by itself.

In another embodiment of the present invention as shown in FIG. 9B and FIG. 9C said support device is integrated into a form fitting garment. Said garment preferably covers at least partially the legs and torso and optionally shoulders and arms of the sailor and is preferably constructed substantially from a highly stretchable textile or neoprene and textile composite or other textile composite such as a textile combined with a waterproof and breathable substrate. In a preferred embodiment shown in FIG. 9B, support material 23 is positioned underneath the main material of the garment 90 and protrudes through the garment at openings 91 to allow for tension adjustment. Lumbar support structure 22 and lower leg support structure 21 are preferably attached and/or integrated into the garment. In another preferred embodiment, support material 23 is enclosed within the garment 90 between 2 or more layers of material to assist in holding the support material in place for ease of use and comfort.

In another preferred embodiment shown in FIG. 9C, support material 23 is integrated into the suit and comprises a textile or neoprene and textile composite or other textile composite that is glued and/or stitched to said garment 90 to reduce the stretch in the combined area. In another preferred embodiment, said support material 23 and/or support structures 21 & 22 are comprised of a flexible and preferably elastomeric polymeric layer that is applied to said garment by means of screen printing, knife coating, direct injection moulding, gluing or hot-melt gluing, fusing, ultrasonic welding or stitching or other process or combination of these processes whereby said polymer layer is configured to provide reduced stretch in the applied areas. In an alternative embodiment of the present invention, said support material 23 is integrated into the panels of the garment by utilising materials of substantially less stretch than surrounding panels. Said support material and/or support structures may be configured with different degrees of stretch and modulus of elasticity as to provide desired support and comfort in specific areas.

In a preferred embodiment of the present invention, said support preferably features abrasion resistant materials and padding in the knee areas and/or seat areas to provide improved durability and comfort.

In another preferred embodiment of the present invention, said garment is configured to provide compression to the sailor's body to improve blood circulation and prevent lactic acid build up.

In another embodiment of the present invention, said support device features rigid or semi-rigid support pads in the rear thigh areas to distribute force when in contact with the deck of a boat. In another potential embodiment the said garment features pockets that allow for the addition of removable pads that can be configured to distribute force when in contact with the deck of a boat. In another potential embodiment said garment may be configured to work with additional thigh sleeves that can be worn underneath or on top of said garment whereby said sleeves feature rigid or semi-rigid support pads configured to distribute force when in contact with the deck of a boat.

Figure 10C:
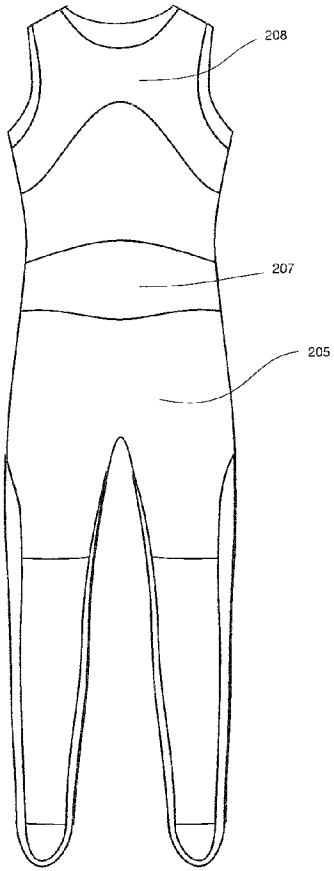
FIGS. 10A, 10B, and 10C illustrate a front, side, and rear view of one embodiment of the present invention, respectively.
Figure 10B:
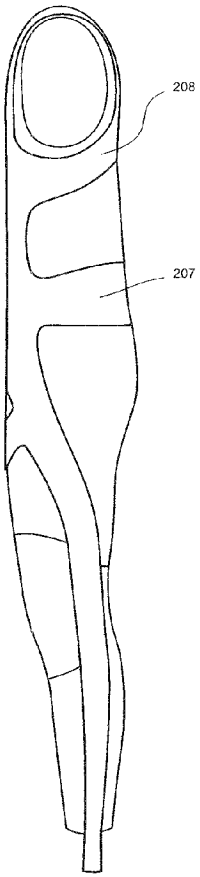
Figure 10A:
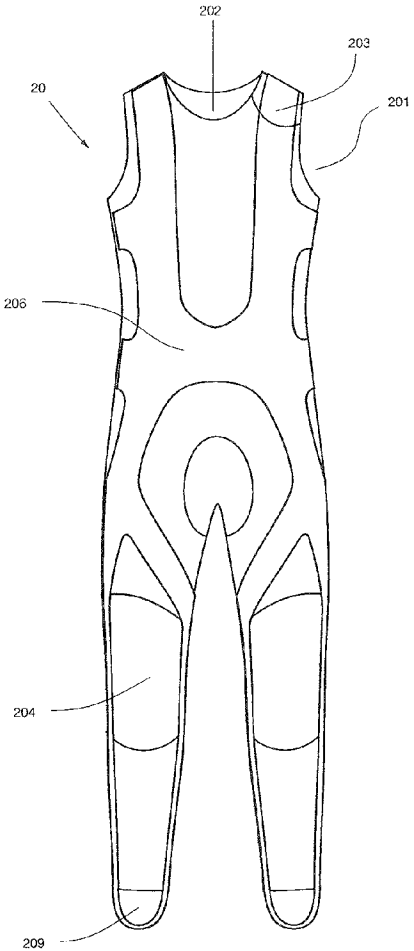

FIGS. 10A, 10B, and 10C show an additional embodiment of the present invention where a garment 20 covers the legs, torso and shoulders of the wearer with arm holes 201 and neck opening 202. In a preferred embodiment said suit features a Velcro closure 203 on at least one shoulder to allow for easy entry into said suit. In another preferred embodiment said suit features additional reinforcement in the knee areas 204 and seat areas 205 to provide improved abrasion resistance. In a preferred embodiment said garment is constructed substantially from a highly stretchable textile or neoprene and textile composite.

In a preferred embodiment of the present invention said garment 20 is constructed by combining textile panels to form a shape that conforms to the wearers body by means of stitching, gluing or seam taping or a combination of these processes. Said textile is preferably a knitted, woven or non-woven textile comprising synthetic or natural fibres such as Nylon, polyester, spandex, polypropylene, wool, cotton or other fibre or combination thereof. In a preferred embodiment said textile is a composite of a knitted, woven or non woven textile with a closed cell foam such as polychloroprene.

In an alternative embodiment of the present invention said garment is constructed with the addition of arms to substantially cover the wearer's entire body. In another alternative embodiment of the present invention, said garment is constructed with an increased neck opening and/or arm openings to provide reduced coverage of the wearer's body. In another alternative embodiment of the present invention, said garment is constructed with reduced length legs as to provide reduced coverage of the wearer's body.

In one preferred embodiment, an additional support structure 206 is combined to said garment 20 whereby said support structure has reduced stretch compared to the main garment material. Said support structure 206 is configured on the garment to resist the backwards-leaning moment of the sailor whilst in the hiking position. In a preferred embodiment said support structure is disposed in a structure that reduces stretch on the front torso and thigh of the sailor thereby reducing stretch in comparison to the rear of said garment. In another preferred embodiment said support structure 206 is disposed around the shoulders 208, lower back 207 and feet by means of foot straps 209 to provide additional anchorage and support to the system.

In a preferred embodiment said support structure 206 comprises a textile or polychloroprene and textile composite or other textile composite that is glued and/or stitched to said garment 20 to reduce the stretch in the combined area. In another preferred embodiment, said support structure 206 is comprised of a flexible and preferably elastic polymeric layer that is applied to said garment by means of screen printing, knife coating, direct injection moulding, gluing or hot-melt gluing, fusing, ultrasonic welding or stitching or other process or combination of these processes whereby said polymer layer is configured to provide reduced stretch in the applied areas.

In an alternative embodiment of the present invention, said garment provides support by configuration the panels of said garment with varying levels of stretch. In a preferred embodiment, the front chest and torso panels are configured to have reduced stretch compared to the rear panels thereby pulling the sailor forward when wearing the suit.

In another alternative embodiment of the present invention, said garment provides support by configuring the patterns of said panels to provide pre-formed shape in a forward leaning posture that thereby resists any backward leaning movement when worn by the sailor.

In another alternative embodiment of the present invention, said garment is manufactured from a moulded rubber or polymeric material in 1 or more pieces.

In another alternative embodiment of the present invention, said garment is configured to provide support to the sailor by a combination of embodiments mentioned above.

What is claimed is:

1. A support device that provides support to a sailor when hiking from the gunnels of a sailing vessel, comprising:

a lumbar support structure configured to be located in a lumbar region of the sailor;

a leg support structure configured to be located in a leg region of the sailor, the leg support structure being configured to wrap around a leg of the sailor in a transverse plane of the leg; and a support material that connects said lumbar support structure to said leg support structure;

wherein said support material is configured to spread a transferred load of the support material across the lumbar support structure.

2. The support device of claim 1, wherein the lumbar support structure and leg support structure is made from a material selected from a group comprising: knitted textile, woven textile, non-woven textile, closed cell foam, or a composite thereof.

3. The support device of claim 2, wherein the group further comprises: open cell foam, waterproof breathable textile composite, or a composite thereof.

4. The support device of claim 1, wherein the lumbar support structure includes a fastener for adjusting the lumbar support structure, the fastener selected from the group consisting of: hook and loop fastener, buckle, or a combination thereof.

5. The support device of claim 1, wherein the lumbar support structure includes at least one rigid support material selected from a group comprising: moulded polymer, extruded polymer, fiberglass composite, carbon fiber composite, aluminum, titanium, steel, or a combination thereof.

6. The support device of claim 1, wherein the support material is placed in tension when the sailor is in a hiking position.

7. The support device of claim 1, wherein the support material is selected from a group comprising: knitted textile, woven textile, non-woven textile, closed cell foam, knitted webbing, woven webbing, open cell foam, polymeric tape, polymeric film, polymeric molding, or a composite thereof.

8. The support device of claim 1, wherein the support material includes a material having less than 5% elongation between said lumbar support structure and said leg support structure prior to tensile failure.

9. The support device of claim 1, wherein the support material comprising an elastomeric material having between 5% and 30% elongation between said lumbar support structure and said leg support structure prior to tensile failure.

10. The support device of claim 1, wherein the support material comprising a high elastic modulus elastomeric webbing that exhibits between 10% to 20% elongation prior to tensile failure.

11. The support device of claim 1, wherein the leg support structure includes fasteners around either the region of each leg below the knee, the region of each lower thigh, or both.

12. The support device of claim 1, wherein the leg support structure includes foot straps.

13. The support device of claim 1, wherein the leg support structure includes rigid support pads positioned underneath thighs of the sailor.

14. The support device of claim 6, further comprising an adjuster that increases the tension of the support material, the adjuster being selected from the group comprising: buckle, rotary adjustment device, hook and loop fastener.

15. A support device that provides support to a sailor when hiking from the gunnels of a sailing vessel comprising:

a lumbar support structure configured to be located in a lumbar region;

a leg support structure configured to be located in a leg region of the sailor the leg support structure configured to wrap around a leg of the sailor in a transverse plane of the leg;

a support material that connects said lumbar support structure to said leg support structure; and a form fitting garment;

wherein the form fitting garment is made from a material selected from a group consisting of: knitted textile, woven textile, non-woven textile, closed cell foam, open cell foam, waterproof breathable textile composite, or a composite thereof.

16. The support device of claim 15, wherein the lumbar support structure and the leg support structure are integrated into the garment.

17. The support device of claim 15, wherein the support material is placed in tension when the sailor is in a hiking position, the support material being at least partially disposed over an outside surface of the garment.

18. The support device of claim 15, wherein the support material is placed in tension when the sailor is in a hiking position, the support material being at least partially disposed under an outside surface of the garment.

19. The support device of claim 15, wherein the support material is placed in tension when the sailor is in a hiking position, the support material being disposed between at least two layers of the garment.

20. The support device of claim 15, further comprising a highly abrasion resistant material in a knee and/or seat region of the garment.

21. The support device of claim 1, wherein the leg region is further defined as a region above the ankle of the sailor.

22. The support device of claim 21, wherein the leg region is further defined as a region below the knee of the sailor.

23. The support device of claim 21, wherein the leg region is further defined as a region in the lower thigh of the sailor.

24. The support device of claim 1, wherein the leg support structure is a first leg support structure, and the support device further comprises a second leg support structure;

wherein the first leg support structure is configured to be located on a first leg of the sailor, and the second leg support structure is configured to be located on a second leg of the sailor.

* * * * *